US011739885B2

(12) United States Patent
Van Bommel et al.

(10) Patent No.: US 11,739,885 B2
(45) Date of Patent: Aug. 29, 2023

(54) LED FILAMENT ARRANGEMENT

(71) Applicant: SIGNIFY HOLDING B.V., Eindhoven (NL)

(72) Inventors: Ties Van Bommel, Horst (NL); Rifat Ata Mustafa Hikmet, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 23 days.

(21) Appl. No.: 17/630,100

(22) PCT Filed: Jul. 16, 2020

(86) PCT No.: PCT/EP2020/070093
§ 371 (c)(1),
(2) Date: Jan. 25, 2022

(87) PCT Pub. No.: WO2021/018606
PCT Pub. Date: Feb. 4, 2021

(65) Prior Publication Data

US 2022/0268404 A1 Aug. 25, 2022

(30) Foreign Application Priority Data

Jul. 26, 2019 (EP) ..... 19188516

(51) Int. Cl.
*F21K 9/232* (2016.01)
*F21Y 115/10* (2016.01)

(52) U.S. Cl.
CPC ..... *F21K 9/232* (2016.08); *F21Y 2115/10* (2016.08)

(58) Field of Classification Search
CPC ... F21K 9/232; F21K 9/23; F21K 9/00; F21Y 2115/10; F21Y 2115/00; F21Y 2111/00; F21Y 2105/10; F21Y 2105/12; F21Y 2101/00; F21V 23/00; F21V 99/00
See application file for complete search history.

(56) References Cited

U.S. PATENT DOCUMENTS 5,463,280 A * 10/1995 Johnson ..... F21K 9/232 362/800
10,260,683 B2 * 4/2019 Bergmann ..... H05B 45/3577
10,859,215 B2 * 12/2020 Chelf ..... F21V 21/0824
(Continued)

FOREIGN PATENT DOCUMENTS

CN 104948958 A 9/2015
CN 107202256 A 9/2017
(Continued)

*Primary Examiner* — Bao Q Truong

(57) ABSTRACT

A light emitting diode, LED, filament arrangement (100) is provided. The LED filament arrangement comprises a LED filament (120) comprising an array of a plurality of light emitting diodes (140), LEDs, arranged on an elongated substrate (70). The LED filament comprises a first subset (S1) of at least two LEDs, and a second subset (S2) of at least two LEDs, wherein the first subset (S1) of LEDs is different from the second subset (S2) of LEDs. The LEDs of the first subset (S1) are coupled in series and the LEDs of the second subset (S2) are coupled in parallel, such that the luminous flux of the individual LEDs of the first subset (S1) differs from the luminous flux of the individual LEDs of the second subset (S2) during operation of the LED filament arrangement.

15 Claims, 3 Drawing Sheets

(56) References Cited

U.S. PATENT DOCUMENTS

| | | | | |
|---|---|---|---|---|
| 11,598,491 | B2 * | 3/2023 | Steele | F21V 9/00 |
| 2005/0040772 | A1 | 2/2005 | Guzman et al. | |
| 2013/0058080 | A1 * | 3/2013 | Ge | H05B 45/357 362/249.02 |
| 2014/0049189 | A1 | 2/2014 | Ter Weeme et al. | |
| 2018/0328543 | A1 | 11/2018 | Bergmann et al. | |
| 2019/0219231 | A1 | 7/2019 | Jiang et al. | |

FOREIGN PATENT DOCUMENTS

| | | | |
|---|---|---|---|
| CN | 107846754 | A | 3/2018 |
| JP | 2011238611 | A | 11/2011 |
| JP | 2012039154 | A | 2/2012 |
| JP | 2013175789 | A | 9/2013 |
| JP | 2014225442 | A | 12/2014 |
| JP | 2015023230 | A | 2/2015 |
| JP | 2017062935 | A | 3/2017 |
| JP | 2019067771 | A | 4/2019 |
| WO | 2018157158 | A1 | 8/2018 |
| WO | 2018158158 | A1 | 9/2018 |
| WO | 2018202625 | A1 | 11/2018 |

* cited by examiner

LED FILAMENT ARRANGEMENT

CROSS-REFERENCE TO PRIOR APPLICATIONS

This application is the U.S. National Phase application under 35 U.S.C. § 371 of International Application No. PCT/EP2020/070093, filed on Jul. 16, 2020, which claims the benefit of European Patent Application No. 19188516.9, filed on Jul. 26, 2019. These applications are hereby incorporated by reference herein.

FIELD OF THE INVENTION

The present invention generally relates to lighting arrangements comprising one or more light emitting diodes. More specifically, the present invention is related to a light emitting diode (LED) filament arrangement.

BACKGROUND OF THE INVENTION

The use of light emitting diodes (LED) for illumination purposes continues to attract attention. Compared to incandescent lamps, fluorescent lamps, neon tube lamps, etc., LEDs provide numerous advantages such as a longer operational life, a reduced power consumption, and an increased efficiency related to the ratio between light energy and heat energy.

There is currently a very large interest in lighting devices and/or arrangements (such as lamps) provided with LEDs, and incandescent lamps are rapidly being replaced by LED-based lighting solutions. It is nevertheless appreciated and desired to have retrofit lighting devices (e.g. lamps) which have the look of an incandescent bulb. For this purpose, it is possible to make use of the infrastructure for producing incandescent lamps based on LED filaments arranged in such a bulb. In particular, LED filament lamps are highly appreciated as they are very decorative.

However, there is a wish to provide alternatives to existing LED filament lamps in order to even further improve the decorative aspect of the light emitted therefrom. More specifically, it is highly desirable to achieve a vintage appearance of the LED filament lamps during operation.

Hence, it is an object of the present invention to provide alternatives to existing LED filament lamps of the prior art in order to obtain a more decorative lighting.

SUMMARY OF THE INVENTION

Hence, it is of interest to overcome at least some of the deficiencies of present LED filament lamps, in order to improve the distribution of light during operation.

This and other objects are achieved by providing a LED filament arrangement having the features in the independent claim. Preferred embodiments are defined in the dependent claims.

A LED filament is providing LED filament light and comprises a plurality of light emitting diodes (LEDs) arranged in a linear array. Preferably, the LED filament has a length L and a width W, wherein L>5W. The LED filament may be arranged in a straight configuration or in a non-straight configuration such as for example a curved configuration, a 2D/3D spiral or a helix. Preferably, the LEDs are arranged on an elongated carrier like for instance a substrate, that may be rigid (made from e.g. a polymer, glass, quartz, metal or sapphire) or flexible (e.g. made of a polymer or metal e.g. a film or foil).

In case the carrier comprises a first major surface and an opposite second major surface, the LEDs are arranged on at least one of these surfaces. The carrier may be reflective or light transmissive, such as translucent and preferably transparent.

The LED filament may comprise an encapsulant at least partly covering at least part of the plurality of LEDs. The encapsulant may also at least partly cover at least one of the first major or second major surface. The encapsulant may be a polymer material which may be flexible such as for example a silicone. Further, the LEDs may be arranged for emitting LED light e.g. of different colors or spectrums. The encapsulant may comprise a luminescent material that is configured to at least partly convert LED light into converted light. The luminescent material may be a phosphor such as an inorganic phosphor and/or quantum dots or rods.

The LED filament may comprise multiple sub-filaments.

Hence, according to the present invention, there is provided a light emitting diode, LED, filament arrangement, comprising at least one LED filament comprising an array of a plurality of light emitting diodes, LEDs, arranged on an elongated substrate, wherein the at least one LED filament comprises at least a first subset, $S_1$, of at least two LEDs, and at least a second subset, $S_2$, of at least two LEDs, wherein the first subset, $S_1$, of LEDs is different from the second subset, $S_2$, of LEDs, and wherein the LEDs of the first subset, $S_1$, are coupled in series and the LEDs of the second subset, $S_2$, are coupled in parallel, such that the luminous flux, $\Phi_1$, of the individual LEDs of the at least a first subset, $S_1$, differs from the luminous flux, $\Phi_{of}$ the individual LEDs of the second subset, $S_2$, during operation of the LED filament arrangement.

Within the context of the present application it should be understood that a subset of LEDs may comprise more than one group. The meaning of LEDs to be coupled in parallel should be interpreted as all the LEDs within one group are in parallel. For instance, in FIG. 2 the subset $S_2$ has 8 LEDs subdivided into two groups and each group has 4 LEDs in parallel.

Thus, the present invention is based on the idea of providing a LED filament arrangement which is able to provide different luminous flux of the individual (identical) LEDs arranged linearly on the substrate during operation of the LED filament arrangement. This effect is achieved by providing one or more first subset(s) of LEDs coupled in series, and one or more second subset(s) of LEDs coupled in parallel. The present invention is hereby advantageous in that the LED filament arrangement may obtain an aesthetically appealing effect by the variance of luminous flux of the LEDs during operation by its innovative concept.

The present invention is further advantageous in that the LED filament arrangement achieves a vintage appearance, which is highly desirable and eligible. Furthermore, the luminous flux difference of the LEDs along the substrate may provide a resemblance of candle light, which even further contributes to the decorative aspect of the LED filament arrangement.

It will be appreciated that the LED filament arrangement of the present invention furthermore comprises relatively few components. The relatively low number of components is advantageous in that the LED filament arrangement is relatively inexpensive to fabricate. Moreover, the relatively low number of components of the LED filament arrangement implies an easier recycling, especially compared to devices or arrangements comprising a relatively high number of components which impede an easy disassembling and/or recycling operation.

The LED filament arrangement according to the present invention comprises at least one LED filament. The at least one LED filament, in its turn, comprises an array of LEDs arranged on an elongated substrate. By the term "array", it is here meant a linear arrangement, row or chain of LEDs, or the like, arranged on the LED filament(s).

The LED filament(s) comprise(s) at least a first subset, $S_1$, of at least two LEDs, and at least a second subset, $S_2$, of at least two LEDs, wherein at least one of the at least one first subset, $S_1$, of LEDs is different from at least one of the at least one second subset, $S_2$, of LEDs. In other words, at least some of the LEDs belonging to the first subset(s) of LEDs are different from at least some of the LEDs belonging to the second subset(s) of LEDs.

The LEDs of the first subset(s), $S_1$, are coupled in series and the LEDs of the second subset(s), $S_2$, are coupled in parallel. By this coupling of the LEDs of the LED filament arrangement, the luminous flux of the individual LEDs of the first subset(s), $S_1$, differs from the luminous flux of the individual LEDs of the second subset(s), $S_2$, during operation of the LED filament arrangement.

According to an embodiment of the present invention, the LED filament arrangement may further comprise at least a third subset, $S_3$, of at least two LEDs, wherein the at third subset, $S_3$, of LEDs is different from the first subset, $S_1$, of LEDs and the second subset, $S_2$, of LEDs, wherein the LEDs of the third subset, $S_3$, are coupled in parallel. The present embodiment is advantageous in that the LEDs of the third subset(s), $S_3$, may provide a luminous flux which is different from the luminous fluxes of the individual LEDs of the first subset(s), $S_1$, and the second subset(s), $S_2$, of LEDs. Consequently, this embodiment may even further contribute to the aesthetically appealing effect of the LED filament arrangement by the variance of luminous flux of the LEDs during operation of the LED filament arrangement.

According to an embodiment of the present invention, the LED filament arrangement may comprise a single electrical circuit for a supply of current to the plurality of LEDs. The present embodiment is advantageous in that the provision of a single electrical circuit achieves a relatively simple yet efficient arrangement in order to achieve the desired, appealing effect of the LED filament arrangement during operation.

According to an embodiment of the present invention, the LED filament arrangement may comprise a plurality of electrical circuits for a supply of current to the plurality of LEDs. The present embodiment is advantageous in that the provision of a plurality of electrical circuits in the LED filament arrangement may conveniently provide different currents to different sets of LEDs, in order to provide a variance of luminous flux of the LEDs during operation of the LED filament arrangement.

According to an embodiment of the present invention, the LEDs may be equidistantly arranged on the substrate. In other words, the LEDs may be arranged on the substrate in a symmetric manner, wherein each LED is arranged at the same distance from adjacently arranged LEDs.

According to an embodiment of the present invention, the LED filament arrangement may further comprise an encapsulant comprising a light-transmissive material, wherein the encapsulant at least partially encloses the plurality of LEDs, wherein the encapsulant comprises a luminescent material and is configured to at least partly convert the light emitted by the plurality of LEDs.

According to an embodiment of the present invention, the encapsulant may further comprise a luminescent material and may be configured to at least partly convert the light emitted by the plurality of LEDs.

According to an embodiment of the present invention, the encapsulant may further comprise light-scattering particles arranged to scatter the light emitted by the plurality of LEDs.

According to an embodiment of the present invention, the plurality of LEDs may have the same color or color temperature. By the term "color temperature", it is here meant the temperature of an ideal black-body radiator that radiates light of a color comparable to that of the LEDs. In other words, the plurality of LEDs may have the same color point. Preferably, the plurality of LEDs may be white LEDs.

According to an embodiment of the present invention, there is provided a lighting device, comprising a LED filament arrangement according to any one of the preceding embodiments. The lighting device further comprises at least one electrical connection connected to the LED filament arrangement for a supply of current to the plurality of LEDs, and a control unit coupled to the at least one electrical connection, wherein the control unit is configured to control the supply of current to the plurality of LEDs. The present embodiment is advantageous in that the control unit may control and/or vary the supply of current to the LEDs such that an even more appealing effect of the LED filament arrangement may be obtained, as a result of the controlled/varied variance of luminous flux of the LEDs via the control unit.

According to an embodiment of the present invention, the control unit may comprise a random current generator configured to supply current which varies randomly, to the plurality of LEDs. By the term "random current generator", it is here meant substantially any generator, unit, or the like, which is configured to generate and supply a current which randomly varies in amplitude with time. The present embodiment is advantageous in that the randomly generated current(s) of the random current generator may even further contribute to obtaining a resemblance of candle light by the light emitted from the LEDs. Consequently, this effect may even further contribute to the decorative aspect of the LED filament arrangement.

According to an embodiment of the present invention, the lighting device may comprise at least one LED filament arrangement, wherein the control unit is configured to control the supply of current individually to each electrical circuit of the plurality of electrical circuits. The present embodiment is advantageous in that the control unit may control and/or vary the supply of current to the LEDs individually in order to vary the luminous flux of the LEDs via the control unit.

According to an embodiment of the present invention, the control unit is further configured to supply at least a first current, $I_1$, to at least a first electrical circuit of the plurality of electrical circuits, and supply at least a second current, $I_2$, to at least a second electrical circuit of the plurality of electrical circuits, wherein $I_1 \neq I_2$. For example, and according to an embodiment of the present invention, $0.5\ I_2 < I_1 < 0.9\ I_2$. The present embodiment is advantageous in that the different electrical circuits may be provided with different currents, which may even further contribute to the decorative aspect of the LED filament arrangement during operation.

According to an embodiment of the present invention, there is provided a lighting arrangement. The lighting arrangement comprises a lighting device according to any one of the preceding embodiments. The lighting device further comprises a cover comprising an at least partially light-transmissive material, wherein the cover at least partially encloses the LED filament arrangement. By the term "cover", it is here meant an enclosing element, such as a cap, cover, envelope, or the like, comprising an at least partial light-transmissive material, e.g. a translucent and/or transparent material. The present embodiment is advantageous in that the lighting device according to the invention may be conveniently arranged in substantially any lighting arrangement, such as a LED filament lamp, luminaire, lighting system, or the like. The lighting arrangement may further comprise a driver for supplying power (current) to the plurality of LEDs of the LED filament arrangement. Additionally, the lighting device of the lighting arrangement may further comprise a controller for individual control of two or more subsets of LEDs of the LED filament arrangement, such as a first set of LEDs, a second set of LEDs, etc.

Further objectives of, features of, and advantages with, the present invention will become apparent when studying the following detailed disclosure, the drawings and the appended claims. Those skilled in the art will realize that different features of the present invention can be combined to create embodiments other than those described in the following.

BRIEF DESCRIPTION OF THE DRAWINGS

This and other aspects of the present invention will now be described in more detail, with reference to the appended drawings showing embodiment(s) of the invention.

DETAILED DESCRIPTION

Figure 1:
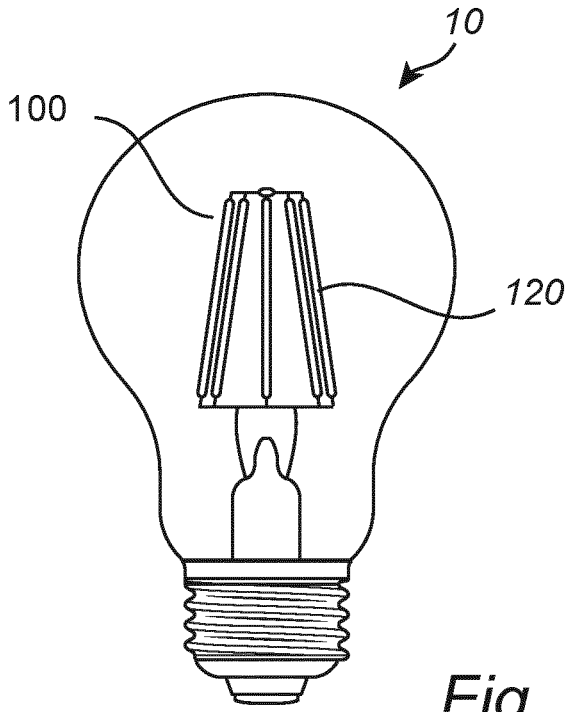
FIG. 1 schematically shows a LED filament lamp according to the prior art, comprising LED filaments, FIGS. 2 and 3 schematically show a LED filament arrangement according to an exemplifying embodiment of the present invention, FIG. 4 schematically shows the intensity of a LED filament arrangement along the length thereof, according to an exemplifying embodiment of the present invention, FIG. 5 schematically shows a LED filament arrangement according to an exemplifying embodiment of the present invention, FIG. 6 schematically shows a lighting device comprising a LED filament arrangement according to an exemplifying embodiment of the present invention, FIG. 7 schematically shows the intensity of a LED filament arrangement along the length thereof, according to an exemplifying embodiment of the present invention, and FIG. 8 schematically shows a lighting device comprising a LED filament arrangement according to an exemplifying embodiment of the present invention.

FIG. 1 shows a LED filament lamp 10 according to the prior art, comprising a LED filament arrangement 100 having a plurality of LED filaments 120. LED filament lamps 10 of this kind are highly appreciated as they are very decorative, as well as providing numerous advantages compared to incandescent lamps such as a longer operational life, a reduced power consumption, and an increased efficiency related to the ratio between light energy and heat energy.

The LED filament arrangement 100 according to the present invention comprises a number of LED filaments 120. For example, the LED filament arrangement may preferably comprise 2-10 LED filaments 120, more preferably 3-8 LED filaments 120, and even more preferred 4-6 LED filaments 120. Albeit a single LED filament 120 is shown in FIG. 2, said LED filament 120 may preferably have a length L in the range from 1 cm to 20 cm, more preferably 2 cm to 12 cm, and most preferred 3 cm to 10 cm.

The LED filament 120 comprises an array or "chain" of LEDs 140 extending along an axis A, which is arranged on an elongated substrate 70 of the LED filament arrangement 100. For example, the array or "chain" of LEDs 140 may comprise a plurality of adjacently arranged LEDs 140. For example, the plurality of LEDs 140 preferably comprises more than 20 LEDs, more preferably more than 25 LEDs, and even more preferred more than 30 LEDs. The plurality of LEDs 140 may be direct emitting LEDs which provide a color. The LEDs 140 are preferably blue LEDs. The LEDs 140 may also be UV LEDs. A combination of LEDs 140, e.g. UV LEDs and blue light LEDs, may be used. The LEDs 140 may comprise laser diodes. The light emitted from the LED filament 120 during operation is preferably white light. The white light is preferably within 15 SDCM from the black body locus (BBL). The color temperature of the white light is preferably in the range of 2000 to 6000 K, more preferably in the range from 2100 to 5000 K, most preferably in the range from 2200 to 4000 K such as for example 2300 K or 2700 K. The white light has preferably a CRI of at least 75, more preferably at least 80, most preferably at least 85 such as for example 90 or 92. The substrate 70 of the LED filament arrangement 100 may be flexible, e.g. a foil. Alternatively, the substrate 70 may be rigid, and e.g. be made of glass, quartz, sapphire and/or a polymer.

Figure 2:
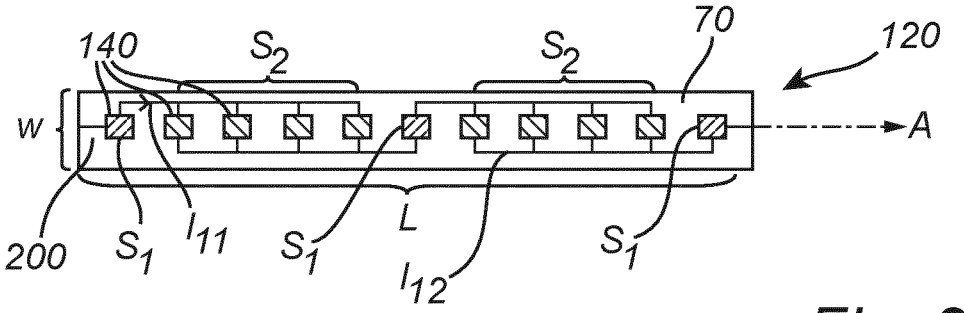

As exemplified in FIG. 2, the LED filament 120 comprises a first subset, $S_1$, of three LEDs 140, and a second subset, $S_2$, of eight LEDs 140. It should be noted that the number of subsets is arbitrary. Analogously, the number of LEDs 140 of the respective subset is arbitrary. The LED filament arrangement 100 comprises a single electrical circuit 200 for a supply of current to the plurality of LEDs 140.

The LEDs 140 of the first subset, $S_1$, are coupled in series and the LEDs 140 of the second subset, $S_2$, are coupled in parallel. The LEDs 140 of the first and second subsets $S_1$ and $S_2$ are identical, i.e. they have the same physical, optical and electrical properties. Hence, the LEDs 140 of the first subset, $S_1$, may be supplied by the same absolute value of a current $I=I_{tot}$ provided to the LED filament 120 by a power source. In contrast, the LEDs 140 of the second subset, $S_2$, may be supplied by the current $I=I_{tot}/4$ provided by the power source, as the LEDs 140 of the second subset, $S_2$, are coupled in parallel with four LEDs each. As a result, the luminous flux of the individual LEDs 140 of the first subset, $S_1$, differs from the luminous flux of the individual LEDs 140 of the second subset, $S_2$, during operation of the LED filament arrangement 100. More specifically, the luminous flux of the individual LEDs 140 of the first subset, $S_1$, is higher than the luminous flux of the individual LEDs 140 of the second subset, $S_2$.

Figure 3:
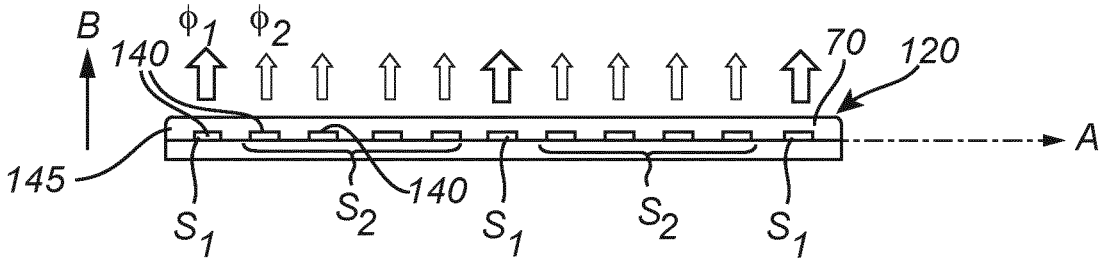

FIG. 3 schematically shows the LED filament arrangement 100 of FIG. 2 in a side perspective according to an embodiment of the present invention. Hence, it is also referred to FIG. 2 for component references and associated description for an increased understanding. The LED filament arrangement 100 comprises a LED filament 120 which elongates along an axis A. Seen in a direction B, perpendicular to the axis A, the LED filament arrangement 100 comprises a substrate 70 for electrical and/or physical support of a plurality of LEDs 140. According to this example, the LEDs 140 of the first subset, $S_1$, are coupled in series and the LEDs 140 of the second subset, $S_2$, are coupled in parallel. The LEDs 140 of the first and second subsets $S_1$ and $S_2$ are identical, i.e. they have the same physical, optical and electrical properties. Hence, the luminous flux, $\Phi_1$, of the individual LEDs 140 of the first subset, $S_1$, differs from the luminous flux, $\Phi_2$, of the individual LEDs 140 of the second subset, $S_2$, during operation of the LED filament arrangement 100. More specifically, the luminous flux, $\Phi_1$, of the individual LEDs 140 of the first subset, $S_1$, is higher than the luminous flux, $\Phi_2$, of the individual LEDs 140 of the second subset, $S_2$, i.e. $\Phi_1>\Phi_2$.

In FIG. 3, the LED filament arrangement 100 further comprises an encapsulant 145 comprising a light-transmissive material, wherein the encapsulant 145 at least partially encloses the plurality of LEDs 140. For example, and as indicated in FIG. 3, the elongated encapsulant 145 fully encloses the plurality of LEDs 140, and hence, also at least a portion of the substrate 70. The encapsulant 145 may comprise a luminescent material, which is configured to emit light under external energy excitation. For example, the luminescent material may comprise a fluorescent material. The luminescent material may comprise an inorganic phosphor, and organic phosphor and/or quantum dots/rods. The UV/blue LED light may be partially or fully absorbed by the luminescent material and converted to light of another color e.g. green, yellow, orange and/or red. The encapsulant 145 may further comprise silicone. The thickness of the encapsulant 145 may preferably be constant along the length of the LED filament 100. Furthermore, the concentration and/or type of luminescent material of the encapsulant 145 may preferably be constant along the LED filament 100.

It will be appreciated that the second surface of the substrate 70 (i.e. the underside of the substrate 70) in FIG. 3, may, in a similar manner as described above, comprise the same or similar components and arrangement as previously described.

Figure 4:
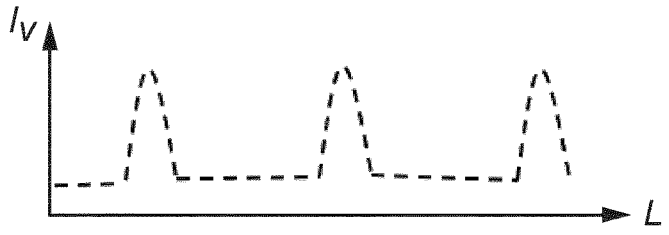

FIG. 4 schematically shows the intensity, $I_v$, of the LED filament arrangement 100 according to FIG. 2 or FIG. 3 along the length, L, of the LED filament arrangement 100. Due to the arrangement of the first subset, $S_1$, of LEDs 140 and the second subset, $S_2$, of LEDs 140, and the coupling in series and in parallel, respectively, of the LEDs 140 of the first and second subsets, $S_1$, $S_2$, the intensity, $I_v$, of the LED filament arrangement 100 varies along the length, L, of the LED filament arrangement 100.

Figure 5:
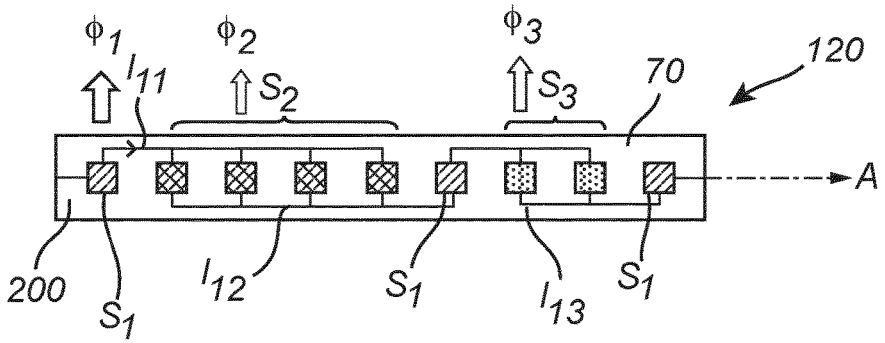

FIG. 5 shows a LED filament arrangement 100 according to an exemplifying embodiment of the present invention. As the LED filament arrangement 100 of FIG. 5 has may features in common with the LED filament arrangement 100 of FIG. 2, it is referred to FIG. 2 for component references and associated description for an increased understanding. The LED filament 120 comprises a first subset, $S_1$, of three LEDs 140, a second subset, $S_2$, of four LEDs 140, and a third subset, $S_3$, of two LEDs 140. The LEDs 140 of the first subset, $S_1$, are coupled in series and the LEDs 140 of the second subset, $S_2$, and third subset, $S_3$, are coupled in parallel. Hence, the LEDs 140 of the first subset, $S_1$, may be supplied by the same absolute value of a current $I_{tot}=I_{11}$ provided to the LED filament 120 by a power source. In contrast, the LEDs 140 of the second subset, $S_2$, may be supplied by the current $I_{12}=I_{11}/4$ provided by the power source, as the LEDs 140 of the second subset, $S_2$, are coupled in parallel with four LEDs 140. Furthermore, the LEDs 140 of the third subset, $S_3$, may be supplied by the current $I_{13}=I_{11}/2$ provided by the power source, as the LEDs 140 of the third subset, $S_3$, are coupled in parallel with two LEDs 140. As a result, the luminous fluxes of the individual LEDs 140 of the first, second and third subsets, $S_1$, $S_2$, $S_3$, differ from each other during operation of the LED filament arrangement 100. More specifically, the luminous flux, $\Phi_1$, of the individual LEDs 140 of the first subset, $S_1$, is higher than the luminous flux, $\Phi_3$, of the individual LEDs 140 of the third subset, $S_3$, which in it turn is higher than the luminous flux, $\Phi_2$, of the individual LEDs 140 of the second subset, $S_2$, i.e. $\Phi_1>\Phi_3>\Phi_2$.

Figure 6:
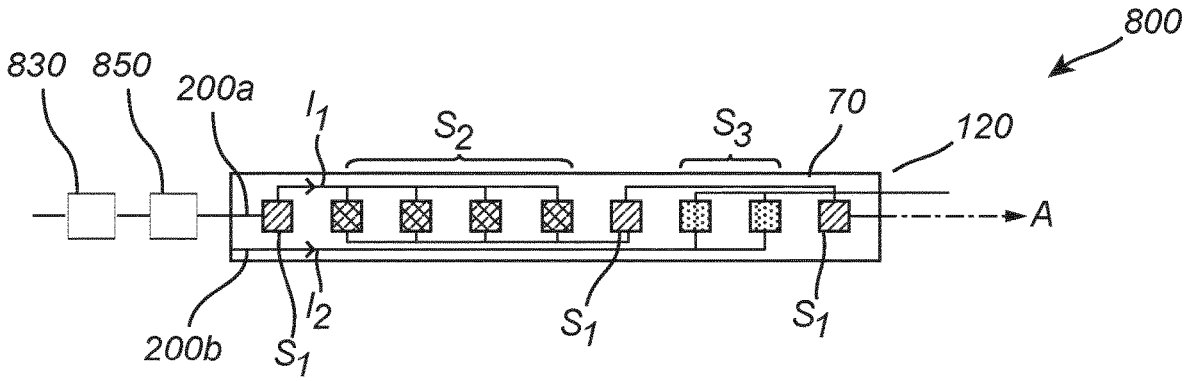
Figure 7:
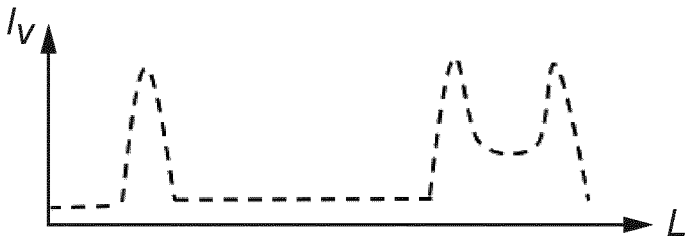

FIG. 6 shows a lighting device 800 according to an exemplifying embodiment of the present invention. The lighting device 800 comprises a LED filament arrangement 100, e.g. according to FIG. 2 or FIG. 5. The lighting device 800 further comprises an electrical connection 830 (e.g. a cap) connected to the LED filament arrangement 120 for a supply of current to the plurality of LEDs 140. The lighting device 800 further comprises a control unit 850 coupled to the electrical connection, wherein the control unit 850 is configured to control the supply of current to the plurality of LEDs 140. For example, the control unit 850 may be configured to control and/or vary the supply of current to the plurality of LEDs 140 such that gentle fluctuations in intensity and/or luminous flux is obtained. In FIG. 6, the lighting device 800 comprises two electrical circuits 200*a*, 200*b* for a supply of current to the plurality of LEDs 140, in contrast to the single electrical circuit 200 of the LED filament arrangement 100 of FIG. 5. More specifically, the first and second subsets, $S_1$, $S_2$, of LEDs 140 are connected to a first electrical circuit 200*a*, and the third subset, $S_3$, of LEDs 140 is connected to the second electrical circuit 200*b*. The first and second electrical circuits 200*a*, 200*b* are electrically isolated from each other. It should be noted, however, that the LED filament arrangement 100 of FIG. 6 may alternatively comprise an arbitrary number of electrical circuits. In case two or more electrical circuits of the LED filament arrangement 120 are provided, as exemplified by the first and second electrical circuits 200*a*, 200*b*, the control unit 850 may be configured to control the supply of current individually to each electrical circuit of the plurality of electrical circuits. For example, the control unit 850 may supply one or more currents, to one or more first electrical circuits of the plurality of electrical circuits, and supply one or more currents, $I_j$, to at least one or more second electrical circuits of the plurality of electrical circuits, wherein $I_i \neq I_j$. For example, in case of two electrical circuits as shown in FIG. 6, the control unit 850 may supply a first current, $I_1$, to the first electrical circuit 200*a* and supply a second current, $I_2$, to the second electrical circuit 200*b*. For example, the control unit 850 may hereby control and/or vary the first and second currents, $I_1$ and $I_2$, such that $0.5\ I_2<I_1<0.9\ I_2$ is fulfilled. In yet another exemplifying embodiment of the LED filament arrangement, the control unit 850 of the lighting device 800 may further comprise a random current generator configured to supply current randomly to the plurality of LEDs 140 of the LED filament arrangement 100. This is schematically shown in FIG. 7 by the intensity, $I_v$, of the LED filament arrangement 100 along the length, L, of the LED filament arrangement 100.

Figure 8:
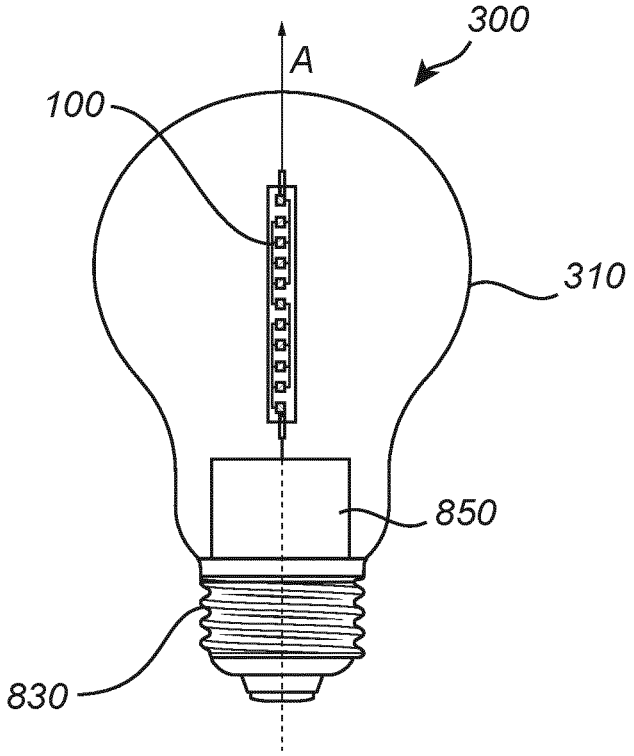

FIG. 8 schematically shows a lighting arrangement 300. The lighting arrangement 300 may comprise a LED filament arrangement 100 or a lighting device which in turn comprises a LED filament arrangement 100, according to any previously exemplified embodiment of the present invention. The lighting arrangement 300 further comprises a cover 310 of light-transmissive material, which material preferably is translucent and more preferably transparent. The cover 310 is exemplified as being bulb-shaped. The lighting arrangement 300 further comprises an electrical connection 830 connected to the LED filament arrangement 100 for a supply of current to the plurality of LEDs 140 of the LED filament arrangement 100. The lighting arrangement 300 further comprises a control unit 850 which is configured to control the supply of current to the plurality of LEDs of the LED filament arrangement 100.

The person skilled in the art realizes that the present invention by no means is limited to the preferred embodiments described above. On the contrary, many modifications and variations are possible within the scope of the appended claims. For example, one or more of the LED filament arrangement(s) 100, LED filament(s) 120, the LEDs 140, etc., may have different shapes, dimensions and/or sizes than those depicted/described.

The invention claimed is:

1. A light emitting diode, LED, filament arrangement, comprising at least one LED filament comprising an array of a plurality of light emitting diodes, LEDs, arranged on an elongated substrate, wherein the at least one LED filament comprises at least a first subset, $S_1$, of at least two LEDs, and at least a second subset, $S_2$, of at least two LEDs, wherein the first subset, $S_1$, of LEDs is different from the second subset, $S_2$, of LEDs, and wherein the LEDs of the first subset, $S_1$, are coupled in series and the LEDs of the second subset, $S_2$, are coupled in parallel, such that the luminous flux, $\Phi_1$, of the individual LEDs of the first subset, $S_1$, differs from the luminous flux, $\Phi_2$, of the individual LEDs of the second subset, $S_2$, during operation of the LED filament arrangement.

2. The LED filament arrangement according to claim 1, further comprising at least a third subset, $S_3$, of at least two LEDs, wherein the third subset, $S_3$, of LEDs is different from the first subset, $S_1$, of LEDs and the second subset, $S_2$, of LEDs, wherein the LEDs of the third subset, $S_3$, are coupled in parallel.

3. The LED filament arrangement according to claim 1, comprising a single electrical circuit for a supply of current to the plurality of LEDs.

4. The LED filament arrangement according to claim 1, comprising a plurality of electrical circuits for a supply of current to the plurality of LEDs.

5. The LED filament arrangement according to claim 1, wherein the LEDs are equidistantly arranged on the substrate.

6. The LED filament arrangement according to claim 1, further comprising an encapsulant comprising a light-transmissive material, wherein the encapsulant at least partially encloses the plurality of LEDs.

7. The LED filament arrangement according to claim 6, wherein the encapsulant further comprises a luminescent material and is configured to at least partly convert the light emitted by the plurality of LEDs.

8. The LED filament arrangement according to claim 6, wherein the encapsulant further comprises light-scattering particles arranged to scatter the light emitted by the plurality of LEDs.

9. The LED filament arrangement according to claim 1, wherein the plurality of LEDs has the same color or color temperature.

10. A lighting device, comprising a LED filament arrangement according to claim 1, at least one electrical connection connected to the LED filament arrangement for a supply of current to the plurality of LEDs, and a control unit coupled to the at least one electrical connection, wherein the control unit is configured to control the supply of current to the plurality of LEDs.

11. The lighting device of claim 10, wherein the control unit comprises a random current generator configured to supply current which varies randomly, to the plurality of LEDs.

12. The lighting device of claim 10, comprising at least one LED filament arrangement, wherein the control unit is configured to control the supply of current individually to each electrical circuit of the plurality of electrical circuits.

13. The lighting device of claim 12, wherein the control unit is further configured to supply at least a first current, $I_1$, to at least a first electrical circuit of the plurality of electrical circuits, and supply at least a second current, $I_2$, to at least a second electrical circuit of the plurality of electrical circuits, wherein $I_1 \neq I_2$.

14. The lighting device of claim 13, wherein $0.5\ I_2 < I_1 < 0.9\ I_2$.

15. A lighting arrangement, comprising a LED filament arrangement according to claim 1 or a lighting device, a cover comprising an at least partially light-transmissive material, wherein the cover at least partially encloses the LED filament arrangement.

* * * * *